United States Patent [19]

Kondo et al.

[11] 4,362,799

[45] Dec. 7, 1982

[54] IMAGE-HOLDING MEMBER WITH A CURABLE EPOXYACRYLATE RESIN INSULATING LAYER

[75] Inventors: Hideyo Kondo, Ibaraki; Yuichi Yashiki, Toride, both of Japan

[73] Assignee: Canon Kabushiki Kaisha, Tokyo, Japan

[21] Appl. No.: 34,024

[22] Filed: Apr. 27, 1979

[30] Foreign Application Priority Data

Apr. 28, 1978 [JP] Japan ..... 53-51840
Apr. 28, 1978 [JP] Japan ..... 53-51841
Nov. 8, 1978 [JP] Japan ..... 53-137725

[51] Int. Cl.[3] ..... G03G 5/10; G03G 5/14

[52] U.S. Cl. ..... 430/67; 430/66; 430/273

[58] Field of Search ..... 428/413; 430/66, 67, 430/271, 273, 44, 270

[56] References Cited

U.S. PATENT DOCUMENTS 3,661,576 5/1972 Crary ..... 430/271
4,092,173 5/1978 Novak et al. ..... 430/66
4,148,637 4/1979 Kubota ..... 430/66
4,181,766 1/1980 Williams et al. ..... 428/413
4,188,449 2/1980 Lu et al. ..... 428/413

FOREIGN PATENT DOCUMENTS 2533371 2/1976 Fed. Rep. of Germany ..... 430/67

OTHER PUBLICATIONS

Research Disclosure 5/73, 10939, p. 67.
Garratt, Jour. Oil and Color Chem. Ass., vol. 56, pp. 266–273, (1973).
Labana, et al., Jour. Paint. Tech., vol. 43, No. 560, pp. 77–80, Sep. 1971.
Miranda, et al., Jour. Paint. Tech., vol. 41, No. 529, pp. 118–129, Feb. 1969.
Jour. Paint. Tech., vol. 44, No. 571, Aug. 1972, pp. 28–39.

*Primary Examiner*—John E. Kittle
*Assistant Examiner*—John L. Goodrow
*Attorney, Agent, or Firm*—Fitzpatrick, Cella, Harper & Scinto

[57] ABSTRACT

Image-holding member for holding electrostatic images and/or toner images comprising an insulating layer composed of curable epoxyacrylate resin on the surface of the image-holding member.

7 Claims, No Drawings

IMAGE-HOLDING MEMBER WITH A CURABLE EPOXYACRYLATE RESIN INSULATING LAYER

BACKGROUND OF THE INVENTION

1. Field of the Invention

The present invention relates to improvements in image-holding member used for holding electrostatic images and/or toner images in electrophotographic image formation process.

2. Description of the Prior Art

Image-holding member is a member on which an electrostatic image and/or a toner image is formed. Electrophotographic photo-sensitive member is one example thereof.

Structure and composition of the electrophotographic photosensitive member vary depending upon the properties required for the member as well as the type of electrophotographic process in which the member is used. Typical electrophotographic photosensitive member now used most widely comprises a support and a photoconductive layer formed thereon. This type of photosensitive member is used for image formation according to the most common electrophotographic process including the steps of electrically charging, image-wise exposure and developing with or without a transferring step.

Sometimes the photosensitive member further comprises an insulating layer as an additional layer serving to protect the photoconductive layer, to improve the mechanical strength of the member, to improve the dark decay characteristic of the member and/or to adapt the member to a particular electrophotographic process. Such photosensitive member comprising an additional insulating layer and the electrophotographic process in which such member is used, are disclosed, for example, in U.S. Pat. No. 2,860,048, Japanese Patent Publication No. 16429/1966 and U.S. Pat. Nos. 3,146,145 (Japanese Patent Publication 15446/1963), 3,607,258 (J.P.P. 3713/1971), 3,666,363 (J.P.P. 23910/1967), 3,734,609 (J.P.P. 24748/1968), 3,457,070 (J.P.P. 19747/1967) and 3,124,456 (J.P.P. 4121/1961).

According to any one of the known electrophotographic processes there is formed on the photosensitive member an electrostatic image which is then developed to visualized the latent image.

Image-holding members other than the above mentioned electrophotographic photosensitive member are also known and used for particular purposes as described hereinafter. These image-holding members comprise no photoconductive layer and are used primarily in the following image forming processes:

(1) Those processes as disclosed in Japanese Patent Publication Nos. 7115/1957, 8204/1957 and 1559/1968. In the process, an electrostatic latent image initially formed on an electrophotographic photosensitive member is transferred to a second image-holding member on which the electrostatic image is developed. The developed toner image is then transferred onto a recording medium. The second image-holding member, that is, a member comprising no photoconductive layer is used to improve the repeating usability of the electrophotographic photosensitive member, that is, the first image-holding member.

(2) Those processes as disclosed in Japanese Patent Publication Nos. 30320/1970 and 5063/1973 and Japanese Patent Application Laid Open No. 341/1976.

According to the electrophotographic process, an electrostatic image is initially formed on an electrophotographic photosensitive member in a form of screen having a plurality of fine openings. Though the first electrostatic image, a second electrostatic image is formed on a second image-holding member by treating the second member with corona charge while modulating the ion flow of corona in accordance with the first formed electrostatic image. The second electrostatic image thus formed is developed with toner and the toner image is transferred to a recording medium to obtain a final image as desired.

(3) An electrostatic image forming process in which an electrostatic image is formed by applying electrical signals to needle-electrodes. In accordance with the electrical signals then applied, an electrostatic image is formed on an image-holding member.

The image-holding member used in the electrostatic image forming processes (1)–(3) needs not have any photoconductive layer and is required only to have an electrostatic image holding surface which should be of electrically insulating.

As will be understood from the foregoing, there are various types of image-holding members including the above mentioned electrophotographic photosensitive member and other image-holding members comprising no photoconductive layer. The electrical characteristics which these image-holding members should have are different from each other. However, it is common to all that such image-holding member should have a good durability. Durability is one of the most important properties which all the image-holding members to be used repeatedly should have. It depends upon the durability of image-holding member whether a sharp and clear image can be obtained or not. For the reason, many attempts have been made to improve the durability of image-holding member. As one of the solutions to this problem it has been already proposed to form the insulating layer from curable (setting type) resin (cf. 2533371, i.e. Japanese Patent Application Laid Open Nos. 15441/1976 and 15442/1976). But, there still remains a problem of selection of curable resin most useful for this purpose. Namely, it is an important problem to find out such kind of resin which can form the best durability of insulating layer while improving also other properties of the image-holding member.

SUMMARY OF THE INVENTION

Accordingly, it is an object of the present invention to provide an image-holding member excellent in durability.

It is another object of the invention to provide an image-holding member the insulating layer of which is excellent in durability and on which always clear and sharp images can be formed even after its long use.

It is a further object of the invention to provide an image-holding member provided with a uniform insulating layer formed using a particularly selected curable resin with the addition of a particular levelling agent so that it has a good surface lubrication property and therefore has a good cleaning property.

It is a still further object of the invention to provide an image-holding member which can be used repeatedly for a long time without any reduction of quality of image.

According to an aspect of the present invention, there is provided an image-holding member for holding electrostatic image and/or toner image comprising an insulating layer composed of a curable epoxyacrylate resin on the surface of said member.

According to another aspect of the present invention, there is provided an image-holding member for holding electrostatic image and/or toner image comprising an insulating layer composed of a curable epoxyacrylate resin and a silicone levelling agent on the surface of said member.

Other and further objects, features and advantages of the invention will appear more fully from the following description of preferred embodiments of the invention.

DESCRIPTION OF THE PREFERRED EMBODIMENTS

According to the invention, the insulating layer of image-holding member is formed using curable epoxyacrylate resin. Compared with other curable resins, the curable epoxyacrylate resin used in the invention has remarkable advantages that it enables to make an image-holding member excellent in durability and that it also enables to make an image-holding member of high moisture resistance as well as high resistance to dielectric breakdown.

Preferable group of curable epoxyacrylate resins used according to the present invention are those which contain, as polymerization unit, bisphenol A diglycidyl ether diacrylate of the general formula:

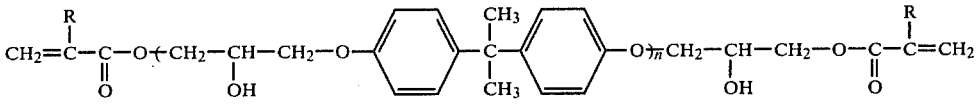

wherein, n=1–3 and R is H or alkyl.

The curable epoxyacrylate resin may contain other polymerization unit monomer if necessary. Examples of such monomer include polyfunctional acrylic monomers such as propylene glycol diacrylate, trimethylolpropane triacrylate, hexanediol diacrylate, ethylene glycol diacrylate and diethylene glycol diacrylate; and methacrylic monomers corresponding to those acrylates. Addition of the above mentioned polyfunctional acrylic monomer gives a more desirable curable epoxyacrylate resin with respect to curing (curing time and hardness).

Formation of the insulating layer using the curable epoxyacrylate resin can be carried out in any suitable manner. For example, it can be carried out by coating the resin on a surface on which an insulating layer is to be formed. For particular cases, a film of the epoxyacrylate resin can be bonded to a surface on which an insulating layer is to be formed. Also, the insulating layer may be formed by coating the curable epoxyacrylate resin on a film of other resin at first and bonding then the coated film on a surface on which an insulating layer is to be formed. In this case, the film is bonded to the surface with the epoxyacrylate resin being remained as the top and non-bonded layer.

Curing of the epoxyacrylate resin can be effected using various means such as heat, light, electron beam and X-ray. Among them, photo-setting and electron beam-setting are preferable.

As another aspect of the invention, it has been found that an addition of silicone levelling agent to the curable epoxyacrylate resin has a particular effect for improving the surface lubrication property of the insulating layer. For example, in case of dry development, the insulating layer is required to have a good surface lubrication property. Addition of silicone levelling agent in accordance with the invention gives the insulating layer a good property to satisfy the requirement in addition to the excellent durability and cleanability. Moreover, the addition of silicone levelling agent has another effect to improve the coating formability of the curable epoxyacrylate resin in making the insulating layer in accordance with the invention.

Preferable groups of silicone levelling agents used in the invention are those which have the following structural formula:

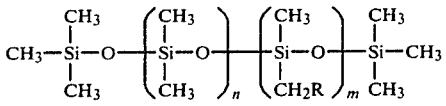

wherein R is selected from the group consisting of H, $CH_3$—, $C_2H_5$—, $C_3H_7$— and $HOCH_2$—, and n and m are positive integral numbers.

Representative examples of such silicone levelling agent include dimethylopolysiloxane wherein R is H, and modified silicones wherein R is modified by the functional group, such as alkyl modified silicone and alcohol modified silicone.

The silicone levelling agent has preferably the molecular weight in the range of from 200 to 100,000, in particular, from 1,000 to 10,000. The content of the levelling agent in the insulating layer according to the invention may vary within a broad range. Usually, it is preferably to use it in the content of from 0.01 to 3 wt %, more preferably in the content of from 0.1 to 1 wt % based on the total weight of the insulating layer.

To accelerate the curing of the epoxyacrylate resin, if necessary, suitable curing agent such as alkyl anthraquinone, dibenzoyl, benzophenone and benzoin alkyl ether may be added. A particularly suitable curing agent is alkyl anthraquinone such as 2-methyl anthraquinone, 2-ethyl anthraquinone and 2-hexyl anthraquinone. By using such kind of curing agent there is formed an insulating layer of good moisture resistance. The curing agent is generally used in an amount of 1 to 5 parts by weight, in particular, 2 to 3 parts by weight per 100 parts of curable epoxyacrylate resin.

In forming the insulating layer, the epoxyacrylate resin may be used together with other kind of resin such as polyethylene, polyester, polypropylene, polystyrene, polyvinyl chloride, polyvinyl acetate, polytetrafluoroethylene, acrylic resin, polycarbonate, silicone resin, fluorine-containing resin or epoxy resin.

The insulating layer is formed much more advantageously by coating rather than by bonding of insulating film to a base surface. Coating method enables to form a seamless insulating layer in case of image-holding member in a form of drum.

When the image-holding member in accordance with the invention is an electrophotographic photosensitive member, it is typically composed of a support, an insulating layer and a photoconductive layer sandwiched in therebetween. The support may be made of any suitable material such as stainless steel, copper, aluminum, tin, paper and resin in a form of sheet or film. The support is not always necessary.

The photoconductive layer may be formed by vapour depositing a suitable inorganic photoconductive materal in vacuum on the support. Examples of suitable inorganic photoconductive material include S, Se and PbO, alloys and intermetallic compounds containing S, Se, Te, As and Sb.

The photoconducitve layer also may be formed according to the sputtering method by depositing on the support a photoconductive substance having a high melting point such as ZnO, CdS, CdSe or $TiO_2$. It may be formed also by coating. In this case, organic photoconductive materials such as polyvinylcarbazole, anthracene, phthalocyanine, those materials sensitized by coloring matter or Lewis acid and also their mixtures with insulating binder can be used. Mixtures of an inorganic photoconductive substance such as ZnO, CdS, $TiO_2$ or PbO and an insulating binder are also suitable. As the insulating binder, various kinds of resins may be used.

The thickness of the photoconductive layer may vary depending upon the kind and property of photoconductive material then used. Generally, it is in the range of from 5 to 100 microns, preferably 10 to 50 microns.

The image-holding member in accordance with the invention may include an additional resin layer containing no epoxyacrylate resin between the insulating layer and the photoconductive layer.

The other type of image-holding member in accordance with the invention which comprises no photoconductive layer may be composed variously. As one typical form, it is composed of a support and an insulating layer overlaid thereon. Another typical form is that which is composed of a support, an insulating layer formed by a material other than epoxyacrylate resin and a top layer of curable epoxyacrylate resin coated on the insulating layer.

The following Examples are given to illustrate the invention. In the examples, parts are expressed as parts by weight unless otherwise specified.

EXAMPLE 1

200 g of Se was weighed and brought into an evaporating dish. The Se was vapour deposited on a substrate (aluminum drum) kept at 67° C. Deposition was carried out using the evaporation temperature of 300° C. and the vacuum in system of $1\times10^{-5}$ torr for thirty five (35) minutes. In this manner, two photoconductive layers were formed, each being 60 microns thick.

On one of the two photoconductive layers thus prepared, an insulating layer was formed using a photo-setting epoxyacrylate resin (trade name "V5501" supplied by Dai Nippon Ink Co. Ltd. in Japan) which contained the following components:

| | |
|---|---|
| Bisphenol A diglycidyl ether acrylate<br>Diethylene glycol diacrylate | 100 Parts |
| Triethanolamine | 4 Parts |
| Benzophenone | 2 Parts |

The resin was diluted with methyl ethyl ketone as a solvent to adjust the viscosity to 90 cps. The photoconductive layer was immersed into the resin liquid and drawn up from the immersion bath at the rate of 30 mm/min. To effect during the coating of the resin, it was subjected to the irradiation of 4 KW mercury lamp for 4 minutes so that a coated layer of 10 microns thick was formed. This coating procedure was repeated three times so as to form an insulating layer having the thickness of 30 microns in total. Thus, a sample of image-holding member comprising a photoconductive layer of 60 microns thick and an insulating layer of 30 microns thick was prepared, which is hereinafter referred to as "Sample A".

Similarly, on the other photoconductive layer there was formed an insulating layer of 30 microns thick in total using a common photo-setting acrylic urethane resin (trade name "SONNE" supplied by Kansai Paint Co. Ltd.) with the irradiation of 4 KW extra-high pressure mercury lamp for five minutes. This control sample is hereinafter referred to as "Sample B".

To evaluate the image formability and durability of the above Samples (A) and (B), they were repeatedly used to form images thereon in an electrophotographic process comprising the steps of primary DC charging with negative polarity, secondary AC charging simultaneous with imagewise exposure, whole surface exposure, wet developing with positive toner and cleaning. Cleaning step was carried out using a polyurethane cleaning blade (hardness=75°, angle relative to the insulating layer=30° and load on the blade=2.5 Kg).

Each of the photosensitive drums of Samples (A) and (B) was rotated 200 thousand times. Test results were as follow:

On Sample (A) there was observed no damage by cleaning and the quality of image was kept good even after the 200 thousand rotations of the drum.

On Sample (B), there was observed some damage caused by cleaning which was in a form of abrasions extending along the circumference of the drum. Developer was penetrated into the abrasions and therefore the cleaning become bad gradually. As a result of the poor cleaning, dirt lines were formed on the images.

EXAMPLE 2

A photosensitive member was prepared in accordance with the invention using a polyester film of 25 microns in thickness and an epoxyacrylate resin having the following:

Bisphenol A diglycidyl ether dimethacrylate: 100 parts
Trimethylolpropane triacrylate: 30 parts
Benzoin ethyl ether: 3 parts The resin was coated on the polyester film (trade name "DAIAFOIL" supplied by Mitsubishi Resin Co. Ltd.,) up to the film thickness of 5 microns using a roller coater. After coating, it was cured under the irradiation of 160 w/cm high pressure mercury lamp for one second while the film being moved at the running speed of 10 m/min. After curing, the thus treated polyester film was bonded to a photoconductive layer with an epoxy bonding agent. The photoconductive layer was of a mixture of CdS and a vinyl chloride-vinyl acetate copolymer binder.

For the purpose of comparison, several photosensitive members were prepared in the same manner as above with the exception that instead of curable epoxyacrylate resin, the following curable resins (a)–(d) were used.

(a) Photo-setting type polyester resin (trade name "UV-CM-102" supplied by Cashew Co. Ltd., curing speed: 3 sec.),
(b) Photosetting type acrylic resin ("PULSLAC 2000" by Chugoku Marine Paints Co. Ltd., curing speed: 4 sec.)
(c) Photo-setting type melamine resin ("CA105" by Nippon Oil and Fat Co. Ltd., curing speed: 3.5 sec.), and
(d) Silicone resin ("KR2019" by Shinetsu Kagaku Co., Ltd., curing speed: 4 sec.).

Tests on image formability and durability were conducted in the same manner as in Example 1 and the following results were obtained:

The surface of the photosensitive member prepared by using epoxyacrylate resin according to the invention was maintained clean even after 250 thousand revolutions of the drum and there was observed no abrasion. The quality of images obtained therefrom continued to be good.

In other photosensitive members there were observed abrasions on their surfaces respectively. Images obtained therefrom were stained with dirt lines and showed a tendency to fogging.

EXAMPLE 3

200 g of Se of 99.999% purity were weighed and brought into an evaporating dish. The Se was deposited on a substrate (aluminum drum) kept 67° C. using the evaporation temperature of 300° C. and vacuum degree in system of $1\times10^{-5}$ torr for thirty five minutes (35 min.). Two photoconductive layers each having the film thickness of 60 microns were prepared in this manner.

On one of the photoconductive layers, an insulating layer was formed by using a photo-setting epoxyacrylate resin (trade name "V 5501" supplied by Dai Nippon Ink Co. Ltd.), diethanolamine and benzophenone in the following manner.

A mixture of 100 parts of the above mentioned resin, 4 parts of diethanolamine and 2 parts of benzophenone was diluted with methyl ethyl ketone so as to prepare a liquid of the viscosity of 90 cps. The photoconductive layer was immersed into the liquid and drawn up at the rate of 30 mm/min. To effect during the coating of resin, it was subjected to the irradiation of 4 KW mercury lamp for five minutes so that a coated layer of 10 microns thick was formed. This coating procedure was repeated three times so as to form an insulating layer having the thickness of 30 microns in total on the photoconductive layer. This sample is hereinafter referred to as "Sample A".

On the other photoconductive layer, an insulating layer was also formed in the following manner:

A mixture of the same photo-setting epoxyacrylate resin (including diethanolamine and benzophenone) as above and an acrylic modified silicone oil (trade name "DC3PA" supplied by Toray Silicone Co. Ltd.,) in the mixture ratio of 99.9:0.1 was diluted with methyl ethyl ketone to prepare a coating liquid of 85 cps. The photoconductive layer was immersed in the liquid bath and drawn up from the bath at the rate of 30 mm/min. To effect curing the coating of resin, it was subjected to the irradiation of 4 KW mercury lamp for six minutes. A layer of 10 microns thick was formed. This coating procedure was repeated three times to form an insulating layer having the thickness of 30 microns in total on the photoconductive layer. This sample is hereinafter referred to as "Sample B".

To determine the lubrication property, image formability and durability of Samples (A) and (B), they were tested in the same process of image formation as described in Example 1 except that dry development was conducted instead of the wet development and in the cleaning step a polyurethane cleaning blade having a hardness of 70° was used with angle relative to the insulating layer being 30° and load on the blade being 2.0 kg.

Test results were as follows:

In case of Sample (A) whose frictional coefficient was 1.85, some abrasion was observed at the edge portion of the cleaning blade after 20,000 rotations of the drum. Furthermore, there was observed formation of film by developer.

In case of Sample (B) whose frictional coefficient was 1.75, the drum continued to rotate smoothly and always good images were obtained. There was observed almost no abrasion or other damage at the edge portion of the cleaning blade even after 50,000 rotations of the drum. The surface of Sample (B) remained clean and no speck of the coating was observed. Image formability was very good. No dielectric breakdown was caused by such a repeated corona charging.

EXAMPLE 4

An Se(99.999% purity)-Te(10wt%) alloy weighing 200 g was brought into an evaporating dish and vapour deposited on a substrate (aluminum drum) kept 68° C. using the evaporation temperature of 320° C. and vacuum degree in system of $1\times10^{-5}$ torr for forty (40) minutes. Two photoconductive layers each being 65 microns thick were formed in this manner.

Onto one of the two photoconductive layers, an insulating layer of 30 microns in thickness was applied in the following manner:

| A photo-setting epoxyacrylate resin containing | |
|---|---|
| Bisphenol A diglycidyl ether dimethacrylate<br>Trimethylolpropane triacrylate | 100 parts |
| Diisopropanolamine | 4 Parts |
| Benzoin methyl ether | 2 Parts |

was diluted with methyl ethyl ketone to prepare a coating liquid of 90 cps in viscosity.

The photoconductive layer was immersed into the liquid bath and drawn up from the bath at the rate of 30 mm/min. Curing was carried out by irradiating the coated layer with a 4 KW mercury lamp for five minutes. This coating procedure was repeated three times to make the layer have the thickness of 30 microns. This sample is hereinafter referred to as "Sample (C)".

Onto the other photoconductive layer, an insulating layer of 20 microns in thickness was firstly applied. To form the insulating layer, the same kind of epoxyacrylate resin as in Sample (C) was used and the same coating procedure as in above was repeated twice so as to adjust the thickness of the insulating layer to 20 microns.

After forming the first insulating layer, a second insulating layer of 10 microns was overlaid thereon in the following manner:

To form the second insulating layer there was used a mixture of photo-setting epoxyacrylate resin containing diiospropanolamine and benzoin methyl ether, which was of the same as used for Sample (C), and an alkyl modified silicone (trade name "DC11PA" supplied by Toray Silicone Co. Ltd.) as a levelling agent.

The mixture was diluated with methyl ethyl ketone to adjust the viscosity of mixture to 85 cps. This coating liquid was sprayed on the first insulating layer while rotating the drum. The coating was cured by irradiating it with a 4 KW mercury lamp for six minutes so that a second insulating layer of 10 microns in thickness was formed overlaid on the first insulating layer. This sample is hereinafter referred to as "Sample (D)".

Tests were conducted on the photosensitive drums of Samples (C) and (D) in the same manner as in Example 3.

Test results were as follows:

Sample (C) was found to have the coefficient of friction of 1.83. After 15,000 rotations of the drum, there were observed some abrasions and breakage at the edge portion of the cleaning blade and slide noise was generated. Cleaning become worse.

Sample (D) was found to have the coefficient of friction of 1.72. Quality of image and cleaning continued to be good. Even after 30,000 rotations of the drum, there was remarked essentially no abrasion at the edge portion of the cleaning blade.

Although a tendency to film formation which is attributable to undesirable adhesion of developer was remarked in Sample (C), such tendency was not observed at all in Sample (D).

EXAMPLES 5–8

A mixture of an epoxyacrylate resin containing triethanolamine and benzophenone, and an alkyl modified silicone in the ratio of 99.9:0.1 was coated on a polyester film of 25 microns thick using a roller coater. Trade names and supplies of the used materials are as follows:

Epoxyacrylate resin:

V 5501, Dai Nippon Ink Co., Ltd.,

Silicone (as levelling agent):

SH 28PA, Toray Silicone Co., Ltd.,

Substrate film: DAIAFOIL Mitsubishi Resin Co., Ltd.

The mixture was coated up to the film thickness of 5 microns. Curing was carried out using a 160 W/cm mercury lamp and a film running speed of 15 m/min.

The coated film was bonded to a photoconductive layer formed from a mixture of CdS and a vinyl chloride-vinyl acetate copolymer binder. Thus, a sample of photosensitive member was prepared.

This sample was tested in the same manner as in Example 3. A good result comparable to that of Sample (B) in Example 3 was obtained.

In stead of mercury lamp, electron beam was also used to cure the epoxyacrylate resin. It was found that an irradiation of 30 M rad was sufficient to form an insulating layer of satisfactory hardness.

Other samples of photosensitive member were prepared using the following various mixtures 6–8 for forming the insulating layers respectively and tested in the same manner as above. All the samples exhibited good results.

6. Epoxyacrylate resin (trade name "CA 102" supplied by Nippon Oils and Fats Co., Ltd.) and Silicone oil (trade name "SH 200" supplied by Toray Silicone Co., Ltd.);
7. Epoxyacrylate resin (trade name "X-4" supplied by TOA Paint Co. Ltd.) and Alcohol modified silicone (trade name "SF 8427" supplied by Toray Silicone Co. Ltd.); and
8. Epoxyacrylate resin (trade name "U-3155" supplied by Showa Kobunshi Co., Ltd.) and Alkyl modified silicone (trade name "SH 230" supplied by Toray Silicone Co., Ltd.).

EXAMPLE 9

Se weighing 200 g was brought into an evaporating dish and deposited on a substrate (aluminum drum) kept 67° C. using the evaporation temperature of 300° C. and the vacuum in system of $1\times10^{-5}$ torr for thirty five (35) minutes so as to form a photoconductive layer of 60 microns thick. In this manner, five aluminum drums each having thereon a photoconductive layer of 60 microns thick were prepared, which are hereinafter preferred to as "Samples 1–5" respectively.

An insulating layer was applied to each the sample by immersion coating method using a mixture of:

Photosetting epoxyacrylate resin ("V5502" supplied by Dai Nippon Ink Co. Ltd.): 100 Parts,
benzophenone: 2 Parts, and
triethanolamine: 4 Parts Curing was carried out by an irradiation of 4 KW mercury lamp. Thickness of the insulating layer was 20 microns for every sample. The condition under which the insulating layer was formed, was varied from one sample to another as given below:

Sample 1: four minutes' light irradiation;
Sample 2: eight minutes' light irradiation;
Sample 3: one mintue's light irradiation;
Sample 4: four minutes' light irradiation followed by an hour's corona discharging onto the surface; and
Sample 5: four minutes' light irradiation followed by standing in air for ten days.

A second insulating layer of 10 microns thick was overlaid on the above first insulating layer of 20 microns in thickness for every sample using the following coating composition A and curing with a 4 KW mercury lamp for four minutes.

Coating composition A

Photo-setting epoxyacrylate resin (trade name "V-5502"): 100 Parts
Benzophenone: 2 Parts
Alkyl modified silicone (trade name "SH28PA"): 0.1 Part
Triethanolamine: 4 Parts These samples resulted after forming the second insulating layer are hereinafter referred to as "Samples 1a–5a".

On the other hand, for another set of Samples 1–5, a second insulating layer of 10 microns thick was applied using the following coating composition B instead of the above composition A.

Coating composition B

Photo-setting epoxyacrylate resin (trade name "V-5502"): 100 Parts
Alkyl modified silicone (trade name "SH28PA"): 0.1 Part
2-Ethylanthraquinone: 2 Parts These samples resulted after forming the second insulating layer are hereinafter referred to as "Samples 1b–5b".

Thus, ten different photosensitive member samples were prepared. To evaluate the image formability thereof, these ten samples, Samples 1a–5a and 1b–5b were tested in the same electrophotographic process as described in Example 1. Tests were conducted under two different conditions, that is, a normal atmospheric condition (25° C. and 60% relative humidity) and a high humidity condition (25° C. and 100% relative humidity after allowing the sample to stand in the atmosphere of 25° C. and 100% relative humidity for ten days).

Images formed on the samples in the electrophotographic process showed the following electrostatic contrast between light part and dark part in each image:

| Sample | Electrostatic contrast (V) under normal condition | Electrostatic contrast (V) under high humidity condition |
|---|---|---|
| 1a | 600 | 450 |
| 2a | 600 | 250 |
| 3a | 600 | 200 |
| 4a | 600 | 150 |
| 5a | 600 | 200 |
| 1b | 600 | 500 |
| 2b | 600 | 500 |
| 3b | 600 | 490 |
| 4b | 600 | 480 |
| 5b | 600 | 500 |

As seen from the above table, under the normal condition there was a good electrostatic contrast for every sample. Under the high humidity condition, however, there was observed a substantial reduction in electrostatic contrast and in image density for Samples 2a, 3a, 4a and 5a.

EXAMPLE 10

Samples of photosensitive member were prepared in the same manner as in Example 9 with the exception that as polymerization initiator the following alkylanthraquinones were used in place of 2-ethylanthraquinone.

2-methylanthraquinone,
2-hexylanthraquinone,
2-isopropylanthraquinone,
2-n-butylanthraquinone,
2,3-diethylanthraquinone,
2,9-diethylanthraquinone They were tested in the same manner as in Example 9 and good results were obtained which were comparable to those of the above Samples 1b–5b.

EXAMPLE 11

Employing the same immersion coating process as in Example 1, a first insulating layer of 10 microns thick was formed on a cylindrical aluminum support (200 mmϕ×500 mm) by using the following photo-setting coating composition:

Epoxyacrylate resin (trade name "V 5502"): 100 Parts
Ethylanthraquinone: 2 Parts
Alkyl modified silicone (trade name "SH28PA"): 0.1 Part Then, a second insulating layer of 5 microns thick was formed on the above first layer in the same manner using the same photo-setting coating composition as that for the first layer.

For every coating, curing was carried out by an irradiation of 4 KW mercury lamp for four minutes.

Thus, an image-holding member comprising an insulating layer having the thickness of 15 microns in total formed on a support was obtained.

The image-holding member was tested in an electrophotographic process as described later to evaluate the image formability and durability of the member. Tests were conducted under a high humidity condition. Good images having high contrast were obtained from the image-holding member in the tests. The durability of the member was also very good.

The electrophotographic process used for the test was of the type which comprises the steps of forming a first electrostatic image on a CdS screen photosensitive member and then forming a second electrostatic image on an image-holding member by corona discharge modulated through the first electrostatic image.

CdS screen photosensitive member mentioned above was made by applying a photoconductive layer of 30 microns in thickness on a stainless wire gauze (opening width: about 50 microns) employing the spray coating method. The composition of the material used for forming the photoconductive layer was as follows:

CdS power: 70 Parts
Silicone resin (trade name "KR-255" supplied by Shinetsu Kagaku Co.): 30 Parts The coating of photoconductive material was dried at the temperature of 80° C. for fifteen (15) minutes. After drying, an insulating layer of 15 microns thick was spray coated on the photoconductive layer. To form the insulating layer there was used a silicone resin (trade name "TSR-144" supplied by Toshiba Silicone Co. Ltd.) containing a curing agent (trade name "CR-15").

The surface of the above described screen photosensitive member was charged up to +450 V and then AC charging simultaneous with imagewise exposure was carried out thereon so that a first electrostatic image was formed which had −50 V at its light area and +200 V at dark area. The image-holding member described above was arranged at the side of stainless wire gauze of the screen photosensitive member and was negatively corona charged through the screen photosensitive member having the first electrostatic image formed therein at that time. As a result, a second electrostatic image was formed on the image-holding member. The electrostatic image was developed with toner and the toner image was transferred onto a transfer sheet while applying a transferring voltage of about −6 KV. After transferring, the toner image was fixed. Thus, a visualized image was obtained.

We claim:

1. An electrophotographic image-holding member for holding electrostatic images and/or toner images comprising a support layer, a photoconductive layer overlying the support layer and an insulating layer on the surface of the member comprising (i) a curable epoxyacrylate resin having as a polymerization unit, bisphenol A diglycidyl ether diacrylate, and (ii) a silicone leveling agent.

2. An image-holding member according to claim 1 further comprising a resin layer between the insulating layer and the photoconductive layer.

3. An image-holding member according to claim 1 wherein the polymerization unit also comprises a polyfunctional acrylic monomer.

4. In image-holding member according to claim 1 wherein a silicone leveling agent is included in the insulating layer.

5. An image-holding member according to claim 1 wherein said insulating layer comprises the silicone levelling agent in an amount of 0.01 to 30 wt%.

6. An image-holding member according to claim 1 wherein said silicone levelling agent is such one which has the general formula

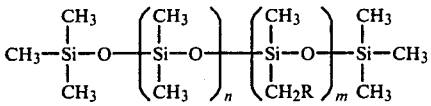

wherein, R is selected from the group consisting of H, $CH_3$—, $C_2H_5$—, $C_3H_7$— and $HOCH_2$— and n and m are positive integers.

7. An image-holding member according to claim 1 wherein the insulating layer contains as a curing agent, an alkylanthraquinone.

* * * * *

UNITED STATES PATENT AND TRADEMARK OFFICE

CERTIFICATE OF CORRECTION

PATENT NO. : 4,362,799

DATED : December 7, 1982

INVENTOR(S) : HIDEYO KONDO, ET AL.

It is certified that error appears in the above-identified patent and that said Letters Patent is hereby corrected as shown below:

Col. 1, line 46, "visualized" should be --visualize--.
Col. 6, line 1, "during" should be --curing--.
Col. 6, line 40, "become" should be --became--.
Col. 9, line 5, "diluated" should be --diluted--.
Col. 9, line 21, "become" should be --became--.
Col. 9, line 54, "In stead" should be --Instead--.

Col. 12, line 66, Claim 4, "In image-holding member according to claim 1 wherein a silicone leveling agent is included in the insulating layer." should be --An image-holding member according to claim 1, further comprising another resin layer between the insulating layer and the support.--.

Col. 13, line 6, Claim 5, "levelling" should be --leveling--.
Col. 13, line 11, Claim 6, "levelling" should be --leveling--.

Signed and Sealed this

Tenth Day of May 1983

[SEAL]

*Attest:*

GERALD J. MOSSINGHOFF

*Attesting Officer*

*Commissioner of Patents and Trademarks*